US006527594B1

(12) United States Patent
Korsunsky et al.

(10) Patent No.: US 6,527,594 B1
(45) Date of Patent: Mar. 4, 2003

(54) MODULAR JACK CONNECTOR HAVING FILTERING DEVICE

(75) Inventors: Iosif Korsunsky, Harrisburg, PA (US); Kevin Walker, Hershey, PA (US); James Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 23 days.

(21) Appl. No.: 10/005,578

(22) Filed: Nov. 7, 2001

(51) Int. Cl.[7] ..... H01R 23/02
(52) U.S. Cl. ..... 439/676; 439/620
(58) Field of Search ..... 439/676, 620

(56) References Cited

U.S. PATENT DOCUMENTS 5,069,641 A * 12/1991 Sakamoto et al. ..... 439/620
5,647,767 A * 7/1997 Scheer et al. ..... 439/620
6,305,950 B1 * 10/2001 Doorhy ..... 439/76.1

* cited by examiner

*Primary Examiner*—Renee Luebke
*Assistant Examiner*—Phuongchi Nguyen

(57) ABSTRACT

A modular jack connector (1) provided includes a housing (10) defining a plug receiving section (11), and a terminal core receiving section (12). A terminal core (20) is received in the terminal core receiving section and configured by at least a plurality of terminals (21) attached to a substrate (30). Each terminal generally includes a base portion (21*a*) attached to the substrate, a contact portion (21*b*) extending into the plug receiving section of the housing, and a tail portion (21*c*) electrically connecting the base portion and extending outside the housing. At least an electrical package (40) has first and second pins (41, 42), and electrically connected to a selected terminal with the first pin, while replacing the tail portion of the selected terminal with the second pin extending from the electrical package.

11 Claims, 4 Drawing Sheets

MODULAR JACK CONNECTOR HAVING FILTERING DEVICE

BACKGROUND OF THE INVENTION

1. Field of the Invention

The present invention relates to a modular jack connector, and more particularly to a modular jack having filtering device, such as magnets integrally packaged with terminal pin so as to simplify assembly.

2. Description of Related Art

U.S. Pat. No. 5,069,641 issued to Sakamoto et al. on Dec. 3, 1991 discloses a modular jack to be mounted on a circuit board and which has a printed circuit board containing a noise suppressing electronic element mounted in a housing. The printed board is fitted with contactors for contacting with plugs and terminals to be used for mounting the modular jack on the circuit board. The contactors and the terminals are electrically connected with the noise suppressing electronic element by wires on the printed board.

U.S. Pat. No. 5,736,910 issued to Townsend et al. discloses a modular jack carries the same idea in which a printed circuit board is disposed within a housing thereof. The printed circuit board carries magnets winding with coil wires to act as a noise suppressing device. As shown in FIG. 5 of Townsend patent, four magnets are incorporated.

It can be appreciated that Sakamoto et al. and Townsend et al. do provide a solution for suppressing noise for high speed signal transmission, however, there suggestion is still not good enough to solve all the problems encountered, especially when attaching the magnets with coil wires onto the printed circuit board.

It can be easily noticed that those coil wires have very fine diameter. It would be very difficult to solder those tiny coil wires onto solder pads on the printed circuit board without proper fixture as well as other auxiliary equipment, such as magnified lens. Accordingly, this will inevitably increasing the complexity of assembly.

On the other hand, those tiny coil wires are exposed and vulnerable for any incidental damage which consequently results malfunction of the connector. There is a requirement for providing a electrical package which can simplify the manufacture of the modular jack.

SUMMARY OF THE INVENTION

Accordingly, the object of the present invention is to provide a modular jack having a packaged magnet integrally formed with at least a selected terminal thereby facilitating easy manufacture of the connector.

In order to achieve the object set forth, a modular jack connector in accordance with the present invention includes a housing defining a plug receiving section, and a terminal core receiving section. A terminal core is received in the terminal core receiving section and configured by a plurality of terminals attached to a substrate. The plurality of terminals each generally includes a base portion attached to the substrate, a contact portion extending into the plug receiving section of the housing and a tail portion electrically connecting with the base portion and extending outside the housing. At least an electrical package having first and second pins is securely supported on the substrate, and electrically connected to a selected terminal with the first pin, while replacing the tail portion of the selected terminal with the second pin extending from the electrical package.

DETAILED DESCRIPTION OF THE INVENTION

Figure 1:
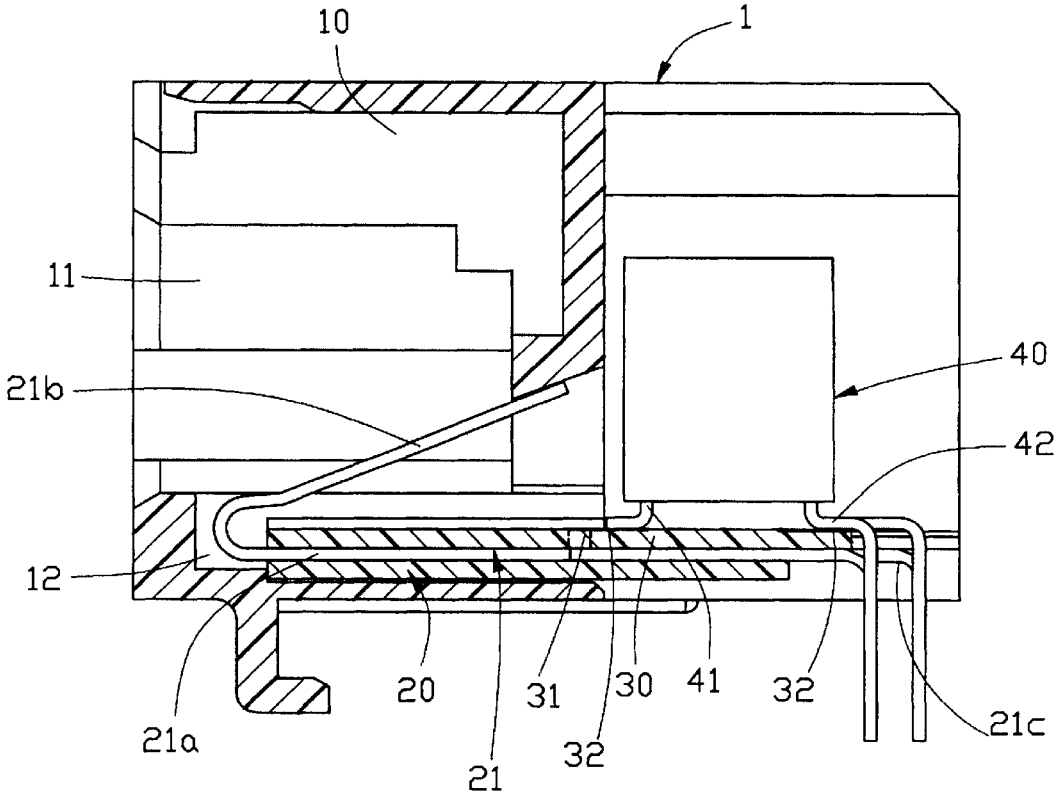
FIG. 1 is a cross sectional view showing a modular jack connector being provided with a packaged magnet of a first embodiment of the present invention.
Figure 2:
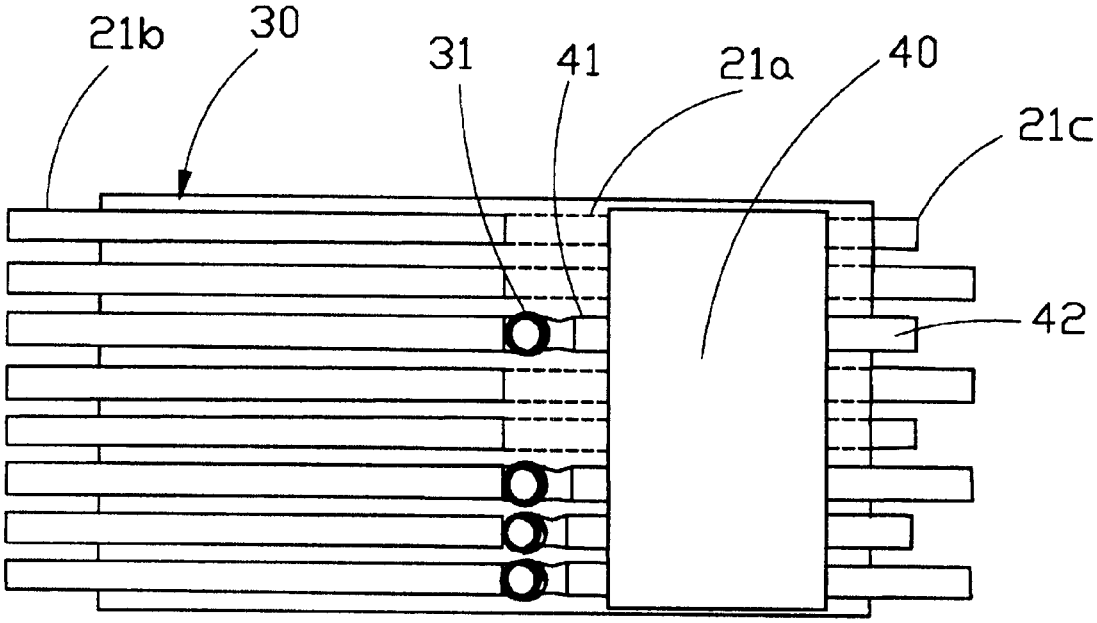
FIG. 2 is a top view of a substrate of a terminal core of the first embodiment in accordance with the present invention.

Referring to FIGS. 1 and 2 of a first embodiment of the present invention, a modular jack connector 1 for mounting unto a main printed circuit board (not shown) in accordance with the present invention includes a housing 10 defining a plug receiving section 11, and a terminal core receiving section 12. A terminal core 20 is received in the terminal core receiving section 12 and configured by at least a plurality of terminals 21 attached to a substrate 30. According to the first embodiment, there are totally eight (8) terminals 21 attached to the substrate 30. A fourth terminal, a fifth terminal, a seventh terminal, and an eighth terminal each of them generally includes a base portion 21*a* attached to the substrate 30, a contact portion 21*b* extending into the plug receiving section 11 of the housing 10 when the terminal core 20 is assembled to the housing 10, and a tail portion 21*c* extending outside the housing 10. A first terminal, a second terminal, a third terminal, and a sixth terminal each of them generally includes a base portion 21*a,* and a contact portion 21*b.* The configuration of the modular jack connector has been disclosed in a copending U.S. application entitled to "RJ Modular Connector Having Printed Circuit Board Having Conductive Trace To Balance Electrical Couplings Between Terminals" filed on May 22, 2001 with Ser. No. 09/863,942, and assigned to the same assignee. Accordingly, no detailed description of the terminal core 20 is given hereinafter.

At least an electrical package 40 has a plurality of magnets with coil wires wound thereon (not shown) and a plurality of first and second pins 41, 42 connecting to the coil wires and securely supported on the substrate 30. A first and a second rows of solder pads 32 are formed on a top face of the substrate 30, and the first row of solder pads 32 is adjacent to the first pins 41 and the second row of solder pads 32 is adjacent to the second pins 42. Each first pin 41 is soldered with a solder pad 32 of the first row of solder pads 32 to electrically connect to one corresponding base portion 21 a of the first, second, third and sixth terminals 21 through a via hole 31 defined on the substrate 30. Each second pin 42 is soldered with a solder pad 32 of the second row of the solder pads 32 and extends directly outside the housing 10 to act as the tail portion 21*c* of the terminal 21. One of the advantages is that the magnets are well secured within the electrical package 40, while only pins 41, 42 extend outside the package 40. By this arrangement, the electrical package 40 can be handled as regular electronic components, such as capacitor and resistance. Thus, to the first, the second, the third and the sixth terminals, electrical signal is transmitted through the contact portions 21*b* of the first, the second, the third and the sixth terminals 21, the base portions 21*a* of the first, the second, the third and the sixth terminals 21, the via holes 31, the pins 41, the coil wires, and the pins 42. In addition, length of the pins 41, 42 can be readily selected according to the requirements. To the fourth, the fifth, the seventh and the eighth terminals 21, electrical signal is transmitted through the contact portions 21*b,* the base portions 21*a,* and the tail portions 21*c*. In the present invention, the pin 41 is formed for surface mounting, while the pin 42 has an angle portion and is formed as a through hole mounting.

Figure 3:
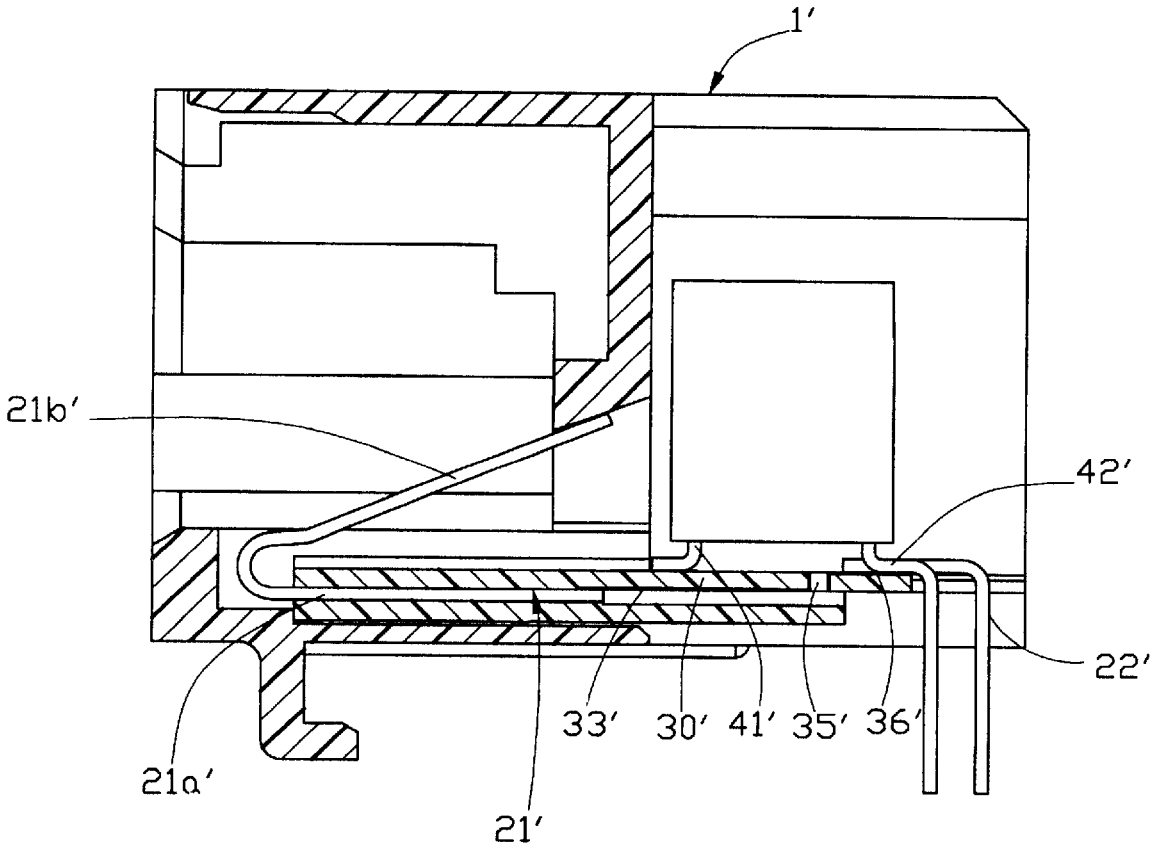
FIG. 3 is a cross sectional view showing a modular jack connector being provided with a packaged magnet of a second embodiment of the present invention.
Figure 4:
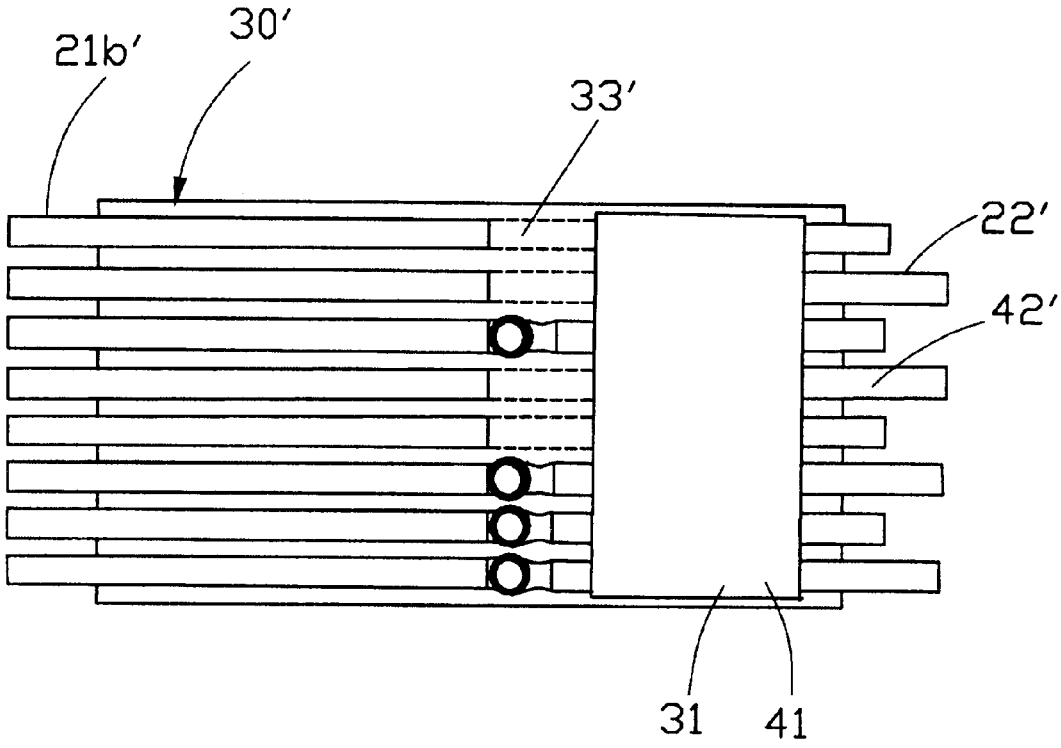
FIG. 4 is a top view of a substrate of a terminal core of the second embodiment in accordance with the present invention.

Referring to FIGS. 3 and 4, in the second embodiment, the modular jack connector 1' has the same configuration with the modular jack connector 1 described in the first embodiment except for arrangement structures of terminals 21' on a substrate 30'. All the terminals 21' in the second embodiment have contact portions 21*b'* and the base portions 21*a'*. There are four conductive traces 33' formed on a bottom face of the substrate 30', four small via holes 35' defined in the substrate 30' connecting the conductive traces 33', and eight solder pads 36' formed on a top face of the substrate 30'. The second legs 42' are soldered with the corresponding solder pads 36'. The fourth, fifth, seventh and eighth terminals 21' each terminal 21' further comprises a tail portion 22' soldered on the solder pads 36'. To the first, second, third and sixth terminals 21', electrical signal is transmitted from the contact portions 21*b',* the base portions 21*a',* the via holes (not shown), the first legs 41' and second legs 42' to the mother board. To the fourth, fifth, seventh and eighth terminals 21', electrical signal is transmitted from the contact portions 21*b',* the base portions 21*a',* the conductive traces 33', the small via holes 35' and the tail portions 22' to the mother board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A modular jack connector, comprising:

a housing defining a plug receiving section, and a terminal core receiving section;

a terminal core received in said terminal core receiving section and configured by a plurality of first and second -terminals attached to a substrate, all the first and second terminals each generally including a base portion attached to the substrate, a contact portion extending into said plug receiving section of the housing, each second terminal further comprising a tail portion integrally formed with the base portion thereof and extending outside the housing; and at least an electrical package having a plurality of first pins and a plurality of second pins corresponding to the first pins, each first pin electrically connected to the base portion of a corresponding first terminal, and the second pins extending outside the housing.

2. The modular jack connector as recited in claim 1, wherein said electrical package includes a plurality of magnets and coil wires wound thereof, said first and second pins being electrically connected to said coil wires.

3. The modular jack connector as recited in claim 1, wherein the substrate further comprises a plurality of via holes, the base portions of the first terminals electrically connecting with the first pins through the via holes.

4. The modular jack connector as recited in claim 1, wherein said second pin includes an angled portion.

5. The modular jack connector as recited in claim 4, wherein said angled portion includes a horizontal portion supported by the substrate.

6. The modular jack connector as recited in claim 5, wherein said angled portion further includes a vertical portion extending downward from the substrate.

7. A modular jack connector, comprising:

a housing defining a plug receiving section, and a terminal core receiving section;

a terminal core received in said terminal core receiving section and configured by at least a plurality of terminals attached to a substrate, each terminal generally including a base portion attached to the substrate, a contact portion extending into said plug receiving section of the housing; and an electrical package having first and second pins arranged corresponding to each other, the first pins electrically connecting with the base portions of selected ones of the terminals and the second pins extending outside the housing, remaining terminals which are not electrically connected with the first pins further having tail portions electrically connecting with the base portions thereof, the tail portions extending outside the housing.

8. The modular jack connector as recited in claim 7, wherein the tail portions are integrally formed with the base portions of the remaining terminals.

9. The modular jack connector as recited in claim 7, wherein the substrate comprises a plurality of conductive traces, each of the conductive traces having a first end electrically connecting the base portion of a corresponding remaining terminal which is not electrically connected with any of the first pins of the electrical package, and a second end electrically connecting the tail portion of the corresponding remaining terminal.

10. The modular jack connector as recited in claim 9, wherein the tail portion of the corresponding remaining terminal electrically connects with said each of the conductive traces through a via hole.

11. A modular jack connector, comprising:

an insulative housing;

a plurality of terminals received within the housing, each of said terminals including a deflectable contact portion and a base portion mounted to an internal printed circuit board; and an electronic package mounted on the internal printed circuit board; wherein said electronic package includes a first pin connected to the base portion of at least one of said terminals, and a second pin extending from the electronic package together with tail portions of other terminals downwardly and outside the housing for mounting to an external printed circuit board on which the housing is seated.

* * * * *